US006248033B1

(12) United States Patent
Lowy

(10) Patent No.: US 6,248,033 B1
(45) Date of Patent: Jun. 19, 2001

(54) DARTS FOR THE GAME OF DARTS

(75) Inventor: Stanley Robert Lowy, Sanderstead (GB)

(73) Assignee: Unicorn Products Limited (GB)

( * ) Notice: Subject to any disclaimer, the term of this patent is extended or adjusted under 35 U.S.C. 154(b) by 0 days.

(21) Appl. No.: 09/011,141

(22) PCT Filed: Nov. 7, 1996

(86) PCT No.: PCT/GB96/01681

§ 371 Date: Oct. 19, 1998

§ 102(e) Date: Oct. 19, 1998

(87) PCT Pub. No.: WO97/03335

PCT Pub. Date: Jan. 30, 1997

(30) Foreign Application Priority Data

Jul. 11, 1995 (GB) ..... 9514075
Aug. 22, 1995 (GB) ..... 9517190

(51) Int. Cl.[7] ..... A63B 65/02
(52) U.S. Cl. ..... 473/578; 473/585
(58) Field of Search ..... 473/578, 582, 473/585, 586, FOR 216, FOR 219, FOR 220, FOR 223

(56) References Cited

U.S. PATENT DOCUMENTS 1,893,787 * 1/1933 Schroeder ..... 473/585 X
4,457,514 * 7/1984 Paxman ..... 473/585
5,009,433 * 4/1991 Reid ..... 473/582

FOREIGN PATENT DOCUMENTS

257853 * 3/1988 (EP) .
367558 * 5/1990 (EP) .
2026878 * 2/1980 (GB) ..... 473/FOR 219
2039755 * 8/1980 (GB) .
1418 * 3/1986 (WO) ..... 473/FOR 219
3242 * 2/1994 (WO) .

* cited by examiner

*Primary Examiner*—John A. Ricci
(74) *Attorney, Agent, or Firm*—Thomas, Kayden, Horstemeyer & Risley

(57) ABSTRACT

A dart for the game of darts has mounting in the form of a bore (12) in the barrel (10, 31) which receives a stem part (13, 30, 44) of a point (13, 30) and/or of a shaft (44) with a flight (45). The stem part is gripped and retained by a spring clip (16) trapped in the bore (12). The stem may be rotatable or not in the bore. A second mounting may also be provided for receiving a threaded portion (43) of a dart shaft (32) or dart point (40). The dart can be provided with interchangeable points (13, 30, 40) and shafts (32, 44) which fit into either of the first and second mountings in dependence upon the point and shaft chosen.

10 Claims, 4 Drawing Sheets

DARTS FOR THE GAME OF DARTS

This invention relates to darts for use in the game of darts.

Most darts consist of a metal dart barrel, a metal dart point, and a rear dart shaft carrying the flight.

Dart points are commonly attached to dart barrels by an interference fit between the rearward diameter of the point and an appropriate cooperating bore in the dart barrel. After a time the dart point wears and conventionally is sharpened on an abrasive stone. After repeated sharpenings the point becomes shorter and eventually too short to allow the dart when thrown to stay in the dartboard. The point cannot be replaced by the user but only by an expert using appropriate tools and if the point cannot be replaced then the dart becomes useless.

Additionally differing styles of throw may require points which protrude by different amounts and, again, points cannot be interchanged by the user.

Dart shafts are conventionally attached to the rear of the dart barrel by a threaded male portion which interfaces with a female threaded end of the dart barrel. This system permits different kinds of shaft, and more particularly different lengths of shaft, to be fitted to a dart barrel to suit differing styles of throw. Dart barrels are known which have a plain hole rearwardly into which a slender shaft without a threaded portion is inserted and held securely by means of interference fit but such an arrangement does not allow the user to change the style or length of the shaft, and if the shaft becomes damaged the whole dart becomes useless.

EP-A-0257853 discloses a dart including a point insertable into a resilient member housed in a bore of the dart body. The resilient member allows limited longitudinal movement of the point relative to the dart body to provide a hammering action of the dart as it hits a dartboard.

GB-A-2039755 discloses a dart having an elongate body with a point sliding in one end of the body and a tail carried at the other end of the body. The point is normally in an extended position. On impact with a target, the momentum of the body causes the point to slide in the body to a position where the body impacts the head of the point and hammers the point into the target thereby reducing the likelihood of bounce of the dart.

WO-A-94/03242 discloses a dart equipped with a dart point contraction system which allows the dart point to contract into the body or barrel of the dart as when the dart point impacts wire, or staples and the like which surmount boundaries of denominated regions of a dartboard. The dart body defines a cylindrical cavity into which the downstream end of the dart point can reciprocatingly travel since it also is cylindrical and comes to rest against the dart body at the end of its travel. It is as a result of the kinetic energy of flight that even though the dart point may have impacted a boundary wire or even a denominated region of the dartboard, that "bounce-out" is inhibited by the cylindrical portion of the dart point travelling in the cylindrical cavity of the dart body when impact occurs.

EP-A-0367558 discloses a dart capable of being used either with a conventional dartboard or an electronic board includes a barrel which carries or is adapted to carry at one end a shaft capable of receiving a flight and is formed at its other end with means by which a point-carrying extension piece can selectively be connected to or disconnected from the barrel. The barrel end may be formed with an internally threaded bore for receiving a threaded member protruding from one end of each of at least two individual point-carrying extension pieces, one such extension piece carrying a metallic point and an other extension piece carrying a non-metallic point.

An aspect of this invention which aims to provide a dart which avoids or reduces the problems mentioned, provides a dart for the game of darts. The spring clip is dimensioned relative to the stem part such that the grip is adequate to retain the stem but the point or the shaft can be removed manually.

During play, if a second or third dart is thrown close to a dart or darts already in the board, the second or third dart may strike or brush against the dart already in the board and be deflected from its given trajectory. Since the cross-section of the dart flight as viewed from the throwing position is significantly greater than that of the dart barrel it is usually the clashing of the flight of a dart already in the board with the barrel or flight of a succeeding dart that causes a deflection.

To overcome this problem, rotating dart flights have been known for some time. Then a following dart is likely, because of its relative weight, to continue on its trajectory when it strikes the rotatable flight of a dart already in the board. It will be obvious that rotation can be achieved if a dart barrel with a fixed point is used in conjunction with a rotating flight, or in an alternative if the flight is fixed relative to a dart body which has a point rotatable with reference to the dart body, or in a further alternative if both the point and the flight are rotatable with reference to each other and to the dart body. Methods of achieving rotation until the present have usually been unreliable having regard to the smallness and nature of the bearing surface available. Usually the bearing is made of a plastic material and is subject to rapid wear and damage, so that frequently the designed degree of freeness in the rotation becomes impeded and following darts cannot overcome the friction which arises progressively through wear or misalignment.

Consequently, one embodiment has a bore which is larger in diameter than the outside diameter of the spring clip, which latter is loose within the bore. In these circumstances, the stem can still rotate although it is retained by the spring clip in the bore. With such an arrangement, it is advantageous to provide a counter-bore at the bottom of the main bore, but of a diameter which matches that of the stem, which can enter the counterbore without being gripped by it. This gives the whole dart point lateral stability.

Certain further developments have also been made in relation to a slightly different aspect of a dart.

Traditionally dart points have been made of hardened and tempered steel and the dart assembly is thrown at a target which may be made of coiled paper or compressed sisal fibres. Much earlier targets were made from a slice of a tree trunk of appropriate species and size. More recently targets have been devised that consist of an open honeycomb structure, commonly in an appropriate plastic material, and the points of the darts used with such targets made of a pliable plastics material. Such darts are colloquially referred to as 'soft tip' darts as opposed to the traditional darts which are described as 'steel tip' or 'steel point'.

The honeycomb formatted dart target may be of a very simple nature but there also exists segmented honeycomb structures adapted so that they can independently of each other impinge on a membrane behind a dartboard face containing a printed circuit. When impacted by a dart the honeycomb impacts onto the membrane and this impact is converted by electronic means to activate scoring devices.

Dart players frequently play in both disciplines, namely steel point or soft tip, and are obliged to use two different sets of darts, one with steel tips and one with soft tips. The object of the present invention is to permit one set only of darts to be used with the minimum of change parts and without the use of complex or special tools.

Darts have been known that can convert from one discipline to another and the conversion is carried out by unscrewing a nose portion containing a steel tip for example and replacing it with a soft tip which has the same connecting thread as the steel tip. This method is unsatisfactory in that the metal to metal thread connection of the steel tip frequently works loose. The cost of creating such a change part is high.

The present invention may in one embodiment also provide a dart which can be simply converted from one discipline to the other which does not suffer from the above problems.

A further aspect of the invention provides a dart bit.

Thus a dart as described above can be provided with a replacement point having a metal stem to engage a mounting as described, the stem having attached to it a soft point. The point may for example be moulded onto the metal stem, or the metal stem may have a male thread engaging a threaded bore in the rear of the soft point.

BRIEF DESCRIPTION OF THE DRAWINGS

Exemplary embodiments are described with reference to accompanying drawings, in which:

FIG. 1 shows to an enlarged scale the front end of a dart body and the stem of a dart point. The dart body 10 is generally circular and narrows towards its front end 11. Centrally at its front end is a bore 12 which receives the rear end of a dart point 13. The bore 12 is enlarged near its aperture to form a circular recess 14, within which is an annular plug 15 which is a force fit therein.

Figure 1:
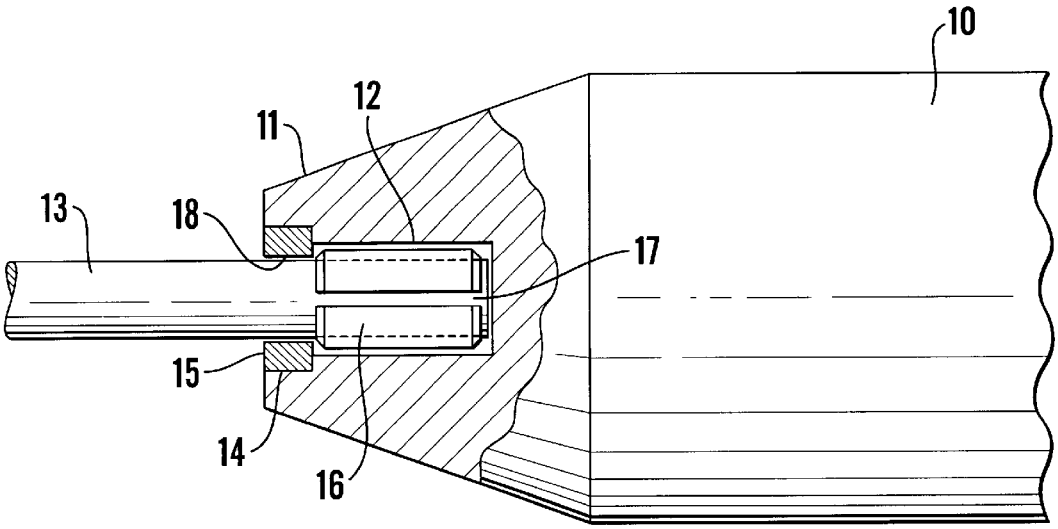
FIG. 1 shows a section of a first embodiment of a dart according to the invention.

The plug 15 overlaps and thus retains in the bore 12 a tubular spring clip 16. During manufacture, this clip is placed in the bore 12, and the plug 15 then inserted to retain it. The clip in its unstressed condition has an internal diameter which is slightly less than the stem 17 of the dart point 13 and an external diameter which is loose in the bore 12. The internal diameter 18 of the plug 15 is a close but not tight fit around the stem 17.

The dart point 13 can be assembled in the dart body 10 by inserting the stem 17 through the aperture 18 and forcing it into the spring clip 16. It can be arranged that the force required to do this can be achieved manually without any special tool. Once pushed fully home, the dart point is retained in the dart barrel 10 and cannot be removed except by a deliberate pull. The dimensions can be such that it can be removed manually, possibly with the aid merely of increased frictional grip on the dart point, for example using a small rubber pad.

If it is desired that the dart point should be rotatable, then the outside diameter of the clip 16 when expanded should not become tightly engaged in the bore 12. It should not, however, be too loose, since this would permit an undue amount of lateral play in the dart point 13.

If it is desired that the dart point should not be rotatable relative to the dart barrel 10, then two possibilities exist. The expansion of the clip 16 may be sufficient to bring the outside surface into firm circumferential contact with the bore 12 so that the dart point 13 and the clip 16 are restrained against rotation. Alternatively, the clip 16 may be dimensioned so that it will never lock circumferentially, but its length may be made sufficiently great that the plug 15 will inevitably trap the clip 16 longitudinally between the bottom of the bore 12 and the inner surface of the plug 15. By either means, the dart point 13 can be prevented from rotation.

Although the above description concerns the dart point, an exactly similar construction may be used to retain the stem of a dart flight at the rear end of a dart barrel. In either case, the point or the flight are firmly held, whether rotatably or not, and can be removed manually in the event of a defect or purely for the purpose of changing the nature of the point or the flight. In particular, it has not previously been feasible to allow a player to change either the length or the shape of a dart point. However, this invention makes possible the provision of interchangeable dart points of differing designs, provided only that the stem 17 at the rear of each dart point is of identical cylindrical shape.

Figure 2:
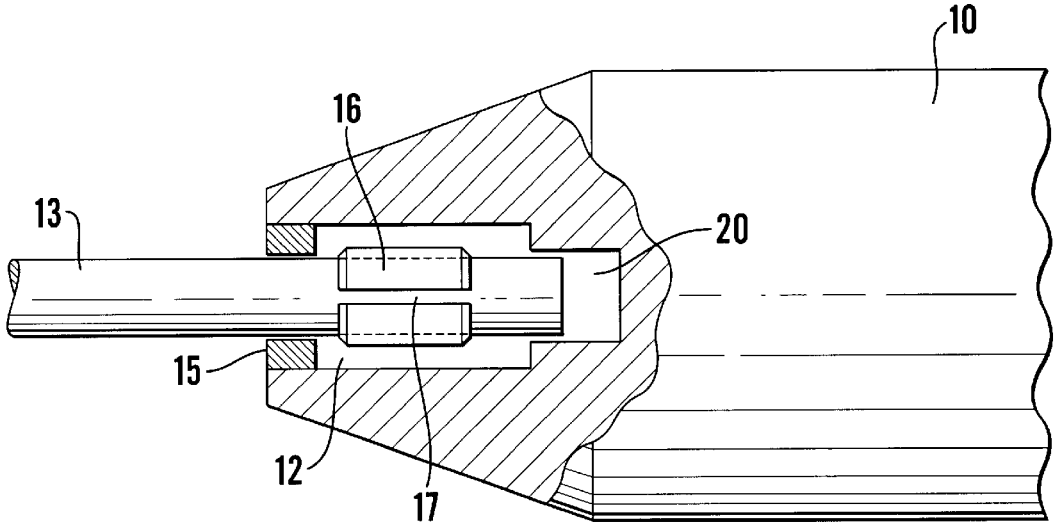
FIG. 2 shows a similar section of a second embodiment thereof.

FIG. 2 illustrates a somewhat modified version of FIG. 1. In this instance, the changes reside in the fact that the enlarged diameter 14 continues for the full length of the bore 12, but a narrower counterbore 20 is introduced at the blind end. This counterbore 20 has a diameter which closely matches the rear end of the stem 17, so that the lateral movement of the point 13 is limited by the plug 15 and the bore 20, which provide in effect spaced bearings. Moreover, the spring clip 16 is in this instance considerably shorter than the depth of the bore 12. This means that the dart point 13 can move longitudinally without becoming disengaged from the dart barrel. The degree of movement is determined by the dimensions of the clip 16 and the counterbore 20, but is arranged to be not sufficient for the rear of the stem 17 to become disengaged from the counterbore.

There is one further aspect which is applicable to the dart point end only. About 9% of the surface of the dartboard is covered by steel wires which delineate the scoring areas. Frequently a dart hits the wire and bounces off the wire on to the floor instead of sticking in the board and the potential score is lost.

Longitudinal movement of the dart point 13 has become a feature of darts in recent years since it is considered to contribute to the ability of the dart to avoid bouncing off the steel wires on the dart board. However, it is felt that the present designs disclosed herein provide better assurance of this "no-bounce" feature. The dart point 13 can be permitted a small amount of lateral movement by virtue of a slight looseness of fit in the plug 15, or by virtue of a slight lateral movement of the stem 17 within either the counterbore 20 or the bore 16 (in the case of FIG. 1). Such lateral movement of the point allows it to "slide past" the rounded contour of the wire, if the dart should actually hit one of them.

In all cases, the internal diameters of the bores involved must be large enough to allow the plug 15 to have a sufficient radial thickness for it to perform its functions. Normally, the dart barrel 10 and point bore is metal, as is the plug 15, and the clip 16 is made of spring steel. However, the plug might be spring steel also if it is necessary for it to be particularly thin.

Figure 3:
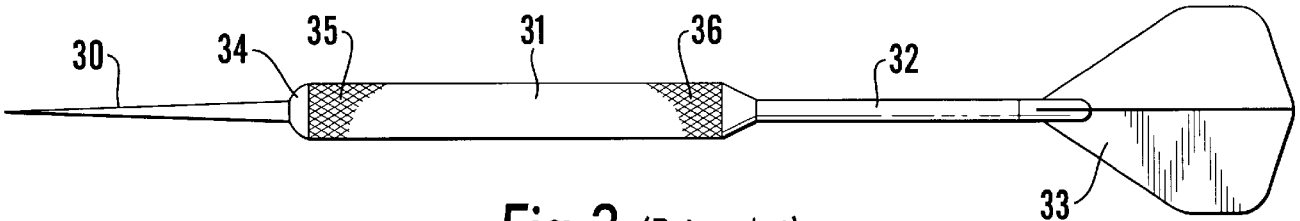
Fig.3 (Prior Art)
FIG. 3 shows a complete conventional dart with a steel point.

FIG. 3 shows a conventional dart having a steel point 30, a metal body 31 and a dart shaft 32 with its flight 33. The point 30 is attached by a mounting 34 within one end 35 of the body 31, which mounting is of the type described previously and illustrated in FIGS. 1 and 2. The dart shaft 32 is attached at the other end 36 of the body 31 by means of a threaded connection at the end of the shaft and internally in the body. Thus both the steel point, and the shaft and flight. can be readily removed.

Figure 4:
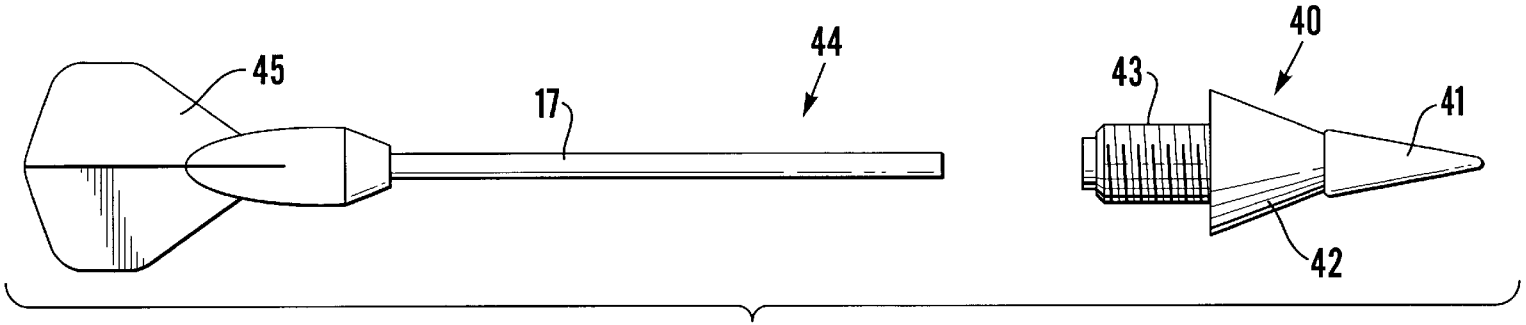
FIG. 4 shows the interchangeable flight shaft assembly and soft point to a larger scale.
Figure 6:
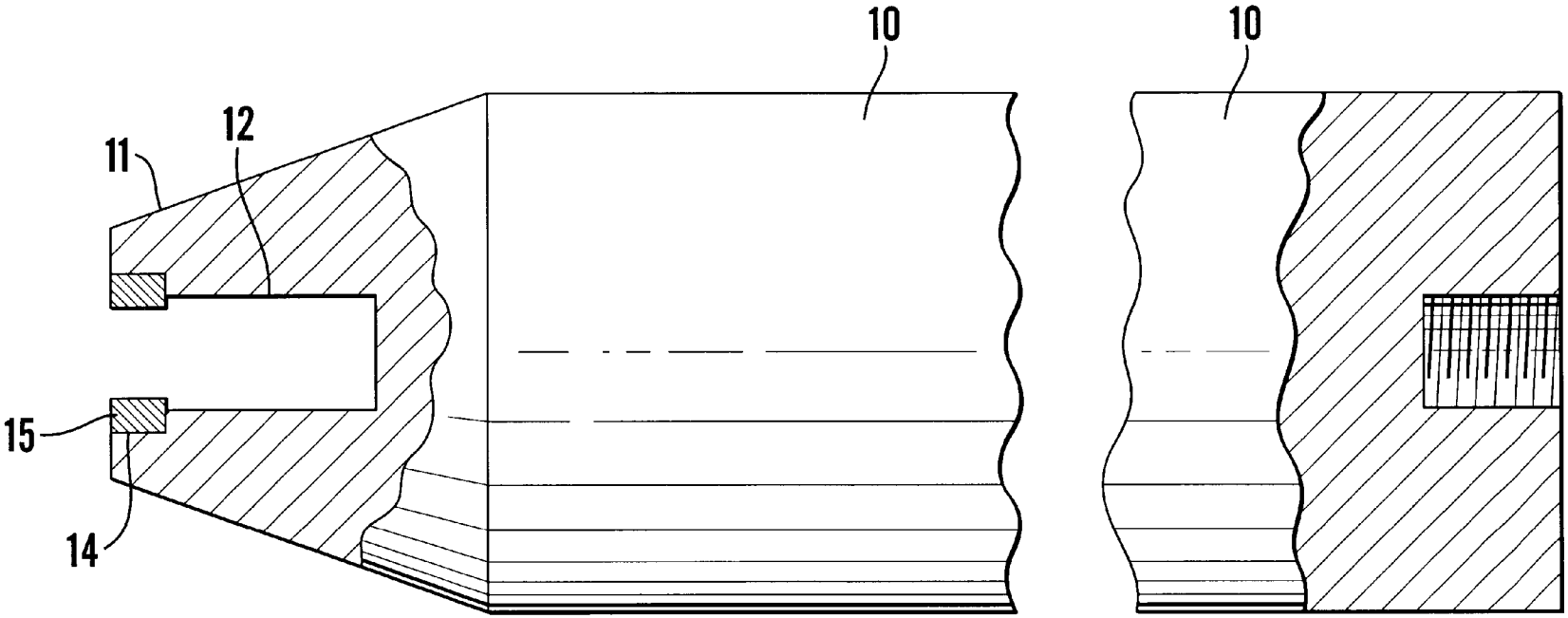
Figure 7:
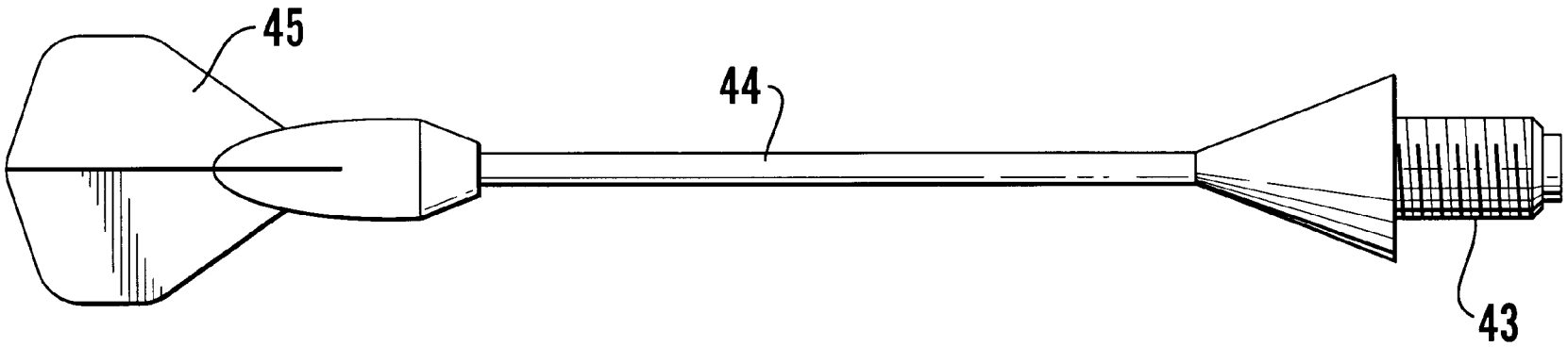

To prepare the dart for use as a soft point dart, a soft point 40 (FIG. 4) moulded in plastics having a point 41, a conical shoulder 42 and a threaded stem part 43, can be screwed into place at the end 36 of the body 31. At the end 35, a straight shaft 44 with flight 45 (FIG. 4) is inserted in the mounting 34 in place of the steel point. The shaft 44 has a smooth external surface with a diameter the same as the steel point 30.

Figure 5:
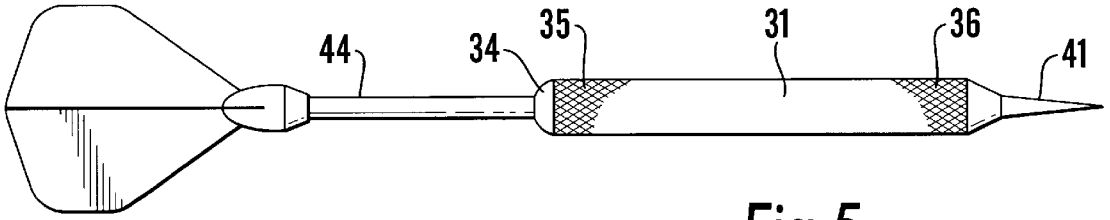
FIG. 5 shows the re-assembled soft point dart.

This shaft 44 may be the same as shaft 32, since the latter may be held in the end 36 of the body 31 by an adapter (not illustrated). The adapter may consist of a threaded stem part and a conical shoulder of similar external design to the soft point 40, but with a central bore to receive the shaft 32 as an interference fit. Thus, shaft 32 when fixed in its adapter may be screwed in and out, and when the adapter is pulled off the shaft, this will have the form of the plain shaft 44 suitable to be inserted in mounting 34. FIG. 5 illustrates the soft point dart ready for use. In effect the direction of the dart has been reversed with the point and flight changing ends. However, since dart players become attached to the weight and feel characteristics of their chosen body, the invention allows them to retain these characteristics for both types of game. Moreover, use of the mounting as previously described gives the advantage of rotatability as also discussed.

In a further embodiment, the fixing method described above may be replaced by a form of threaded fixing for the steel point in which a thread is cut or rolled onto the stem of the point itself, thus avoiding the problem discussed in relation to the known method of interchanging steel and soft points. A similarly threaded flight stem is then required for when the conversion is made.

What is claimed is:

1. A dart for the game of darts having a metal point (13), a dart barrel (10,31), and a shaft (44) with a flight, wherein a stem part (17) of the point (13) and/or of the shaft (44) has a mounting in the dart barrel (10,31) which permits insertion and removal of the stem part, said mounting in either case comprising a bore (12) in an end of the barrel, a spring clip (16) within the bore which frictionally grips said stem part, and an annular plug (15) at the open end of the bore which surrounds said stem part (17) and prevents the spring clip (16) from leaving the bore; wherein when engaged around said stem part, the spring clip (16) is free-floating in the bore (12) and allows free lateral movement of point (13) relative to the dart barrel.

2. A dart as claimed in claim 1 wherein, when engaged the spring clip (16) is around said stem part, the latter is free to rotate in the dart barrel.

3. A dart as claimed in claim 1, wherein, when the sprint-clip (16) is engaged around said stem part, the latter is free for limited longitudinal movement in the dart barrel.

4. A dart as claimed in claim 1, wherein the spring clip is dimensioned relative to the stem part such that the grip is adequate to retain the step but the point or the shaft can be removed manually.

5. A dart as claimed in claim 1, wherein the barrel includes a second mounting for holding the other of the point and the shaft, the barrel allowing for attachment of points and shafts to either of the first and second mountings.

6. A dart according to claim 5, wherein the second mounting includes a threaded bore able to receive a threaded portion (43) of the other of the point and/or shaft.

7. A dart according to claim 6, including a point with a stem part receivable in the first mounting and a shaft with a threaded portion receivable in the second mounting.

8. A dart according to claim 7, including a point with a threaded portion receivable in the second mounting and a shaft with a stem part receivable in the first mounting.

9. A dart according to claim 8, wherein the point includes a metal threaded portion for engaging the second mounting and a soft point.

10. A dart for a game of darts having a metal point (13), a dart barrel (10, 31), and a shaft (44) with a flight, wherein a stem part (17) of the point (13 and/or of the shaft (44) has a mounting in the dart barrel (10, 31) which permits insertion and removal of the stem part, said mounting in either case comprising a bore (12) in an end of the barrel, a spring clip (16) within the bore which frictionally grips said stem part, and an annular plug (15) at the open end of the bore which surrounds said stem part (17) and prevents the spring clip (16) from leaving the bore; wherein when engaged around said stem part, the spring clip (16) is free-floating in the bore (12) and allows free lateral movement of point (13) relative to the barrel, wherein the bottom of the bore has a counterbore (20) which receives the end of the stem part with a close but not interference fit.

* * * * *